United States Patent [19]

Beneke et al.

[11] Patent Number: 4,902,492

[45] Date of Patent: Feb. 20, 1990

[54] NOVEL SPINNING METHOD

[75] Inventors: Herbert Beneke, Castrop-Rauxel; Gerd Collin, Duisburg; Manfred Meinbreckse, Friedrichsdorf; Gerhard Wilhelm, Ladenburg, all of Fed. Rep. of Germany

[73] Assignee: Rutgerswerke AG, Fed. Rep. of Germany

[21] Appl. No.: 258,394

[22] Filed: Oct. 17, 1988

[30] Foreign Application Priority Data

Oct. 28, 1987 [DE] Fed. Rep. of Germany ..... 3736494

[51] Int. Cl.[4] ..... D01F 9/12

[52] U.S. Cl. ..... 423/447.4; 423/447.1; 423/447.2; 423/447.6; 246/29.2; 208/39

[58] Field of Search ..... 423/447.1, 447.2, 447.4, 423/447.6; 264/29.2; 208/39

[56] References Cited

U.S. PATENT DOCUMENTS

| | | | |
|---|---|---|---|
| 3,035,308 | 5/1962 | Ragoss et al. | 208/39 |
| 3,784,679 | 1/1974 | Chiche | 423/447.1 |
| 3,919,387 | 11/1975 | Singer | 264/29.2 |
| 4,146,576 | 3/1979 | Wyss | 423/447.4 |
| 4,470,960 | 9/1984 | Uemura et al. | 423/447.1 |
| 4,596,652 | 6/1986 | Shibatoni et al. | 423/447.2 |
| 4,631,181 | 12/1986 | Matsumoto et al. | 423/445 |
| 4,705,618 | 11/1987 | Tsuchitani et al. | 423/447.1 |

FOREIGN PATENT DOCUMENTS

| | | | |
|---|---|---|---|
| 61-108725 | 5/1986 | Japan | 264/29.2 |
| 63-83197 | 4/1988 | Japan | 423/447.4 |

*Primary Examiner*—Robert L. Stoll
*Assistant Examiner*—Robert M. Kunemund
*Attorney, Agent, or Firm*—Bierman & Muserlian

[57] ABSTRACT

In a process for the production of carbon fibers from high boiling bituminous substances in which a purified and polymerized concentrated carbon fiber precursor is spun into fibers which are oxidized and then carbonized and optionally graphitized, the improvement comprising adding to the carbon fiber precursor just before spinning 2 to 10% by weight of a solvent in which the precursor is insoluble or only slightly soluble under normal conditions and mixing the resulting mixture under hypercritical conditions for the solvent for at least 10 minutes without gas or solid inclusions formed in the fiber and neoformatgion of solids is prevented.

4 Claims, No Drawings

NOVEL SPINNING METHOD

STATE OF THE ART

Methods for carbon fibers production made from bituminous substances of high boiling point, as for instance coal tar pitch, petroleum pitch, residual oils of coal liquefaction, and synthetic pitches are known per se. The bituminous substances are purified and polymerized, optionally after a pretreatment, which results in a mesophase pitch with different amounts of anisotropic pitch components from which the more volatile and isotropic components must be removed at least in part to obtain a carbon fiber precursor with a high proportion of optically anisotropic material.

This precursor should meet the following requirements:

(a) The proportion of solids should be low so that filament ruptures will not occur in spinning.

(b) Under spinning conditions, there must be no development of gas to avoid filament ruptures.

(c) The viscosity should be low at high coking residue so that the precursor can be spun at temperatures which are clearly below the polymerization temperature.

The precursor is usually spun through an extruder, and the pitch filament is made non-fusible by oxidation, carbonization, and possibly graphitization. Purification of the bituminous substances can be effected by filtration or extraction with optional removal of the solvent by distillation. This process step is not critical and its technology is established.

The polymerization is carried out at elevated temperatures with or without catalyst and the conditions are chosen so that as little quinoline insoluble matter (QI) as possible but as high a proportion of optically anisotropic material forms. The tendency to form QI can be reduced by prior hydrogenation and the catalysts, if any are used, must be removed totally from the mesophase pitch. To obtain a sufficiently high proportion of anisotropic material already during the polymerization, this process step may be carried out under high vacuum or with introduction of a carrier gas. However, the neoformation of quinoline insoluble matter cannot be avoid completely, so that often an extraction step must follow the polymerization. The solvent used must be removed totally from the carbon fiber precursor by distillation under gentle conditions.

There remains as residue a high-viscosity substance melting at temperatures above about 250° C. which is spun at temperatures about 100 K. higher. Spinning temperatures up to about 400° C. are quite common. The precursor product continues to polymerize, and there is danger that solids will form which would lead to filament ruptures or even clog the spinning nozzle. But high flow points are necessary so that the pitch filaments will still have sufficient strength in the oxidation process beginning at temperatures above 200° C. and will not gum up. This problem has not been solved satisfactorily thus far and it is the main reason why the production of carbon fibers from pitch has not yet been adopted on an industrial scale.

OBJECTS OF THE INVENTION

It is an object of the invention to provide a novel process for the production of carbon fibers wherein the precursor of high melting point can be spun at relatively low temperatures.

It is another object of the invention to provide improved carbon fibers produced by the process.

These and other objects and advantages of the invention will become obvious from the following detailed description.

THE INVENTION

In the novel process of the invention for the production of carbon fibers from high boiling bituminous substances in which a purified and polymerized concentrated carbon fiber precursor is spun into fibers which are oxidized and then carbonized and optionally graphitized, the improvement comprises adding to the carbon fiber precursor just before spinning 2 to 10% by weight of a solvent in which the precursor is insoluble or only slighly soluble under normal conditions and mixing the resulting mixture under hypercritical conditions for the solvent for at least 10 minutes.

Examples of suitable solvents are high boiling alcohols such as heptanol or octanol and water which are present in liquid form under 100° C. at normal pressure. Due to its hypercritical state during the process, the solvent is completely and homogenously dissolved in the precursor.

Surprisingly, it was found that no segregation occurs in spinning even over a period of about 15 minutes. The precursor could be spun for longer than 60 minutes without filament rupture at temperatures not more than 30 K. above the melting point to form fibers of a thickness of 10 μm. The spinning nozzles showed no clogging, even after long term tests of several days. In the oxidation process, the predominant portion of the solvent diffuses out of the fiber and no gas bubbles are found remaining in the fiber.

In the following examples there are described several preferred embodiments to illustrate the invention. However, it should be understood that the invention is not intended to be limited to the specific embodiments.

EXAMPLE 1

100 parts by weight of a carbon fiber precursor derived from coal tar having the following properties:

Flow point: 295° C.
Quinoline insolubles: 8% wt.
Toluene insolubles: 84% wt.
Coking residue (alkane): 94% wt.
Optical anisotropy: 85% vol.

were heated to 360° C. under a nitrogen pressure of 50 bars in a stirrer. While stirring intensively, 40 parts by weight of heptanol were added uniformly over 10 minutes and the mixture was intensively stirred for another 10 minutes. The mixture was cooled to 320° C. and spun through a dual-shaft extruder with a die plate over 15 minutes at a draw-off rate of 500 m/minute and the die plate had 6 holes of a diameter of 0.8 mm. The 10 μm thick pitch filaments were cooled and wound. In a second stirrer, an additional batch was prepared for spinning at the same time so that the spinning test can be continued without interruption.

The test was stopped after 75 minutes and up to that time, no filament rupture had occurred. The pitch fibers were heated in air at 3 K./minute to 150° C. and then at 1 K./minute to 300° C. and this temperature was maintained for 30 minutes to stabilize the fibers by oxidation. Subsequently, the stabilized fibers were heated in a nitrogen atmosphere at 5 K./minute to 1000° C. and this temperature was maintained for 30 minutes to carbonize the fibers. The carbonized fibers were graphitized in an argon stream with a temperature rise of 25 K./minute to 2500° C. The tensile strength was 2.5 $kN/mm^2$ with a modulus of elasticity of 0.4 $MN/mm^2$ and no visible gas or solids inclusions were perceptible at the fractures.

EXAMPLE 2 (Comparison)

The same carbon fiber precursor as in Example 1 was heated to 320° C. and was fed directly to the extruder with die plate. The tenacity was so high that the shear pin of the extruder drive broke off. No pitch issued from the die plate.

EXAMPLE 3 (Comparison)

The test of Example 2 was repeated at a temperature raised only 20 K. each time. At a temperature of 400 C., it was possible to spin pitch filaments at a draw-off rate of 300 K./minute and the fibers had a diameter of 15 μm. However, a filament rupture occurred after only 8 minutes. The test was continued but after 4 hours, the die plate was clogged with solids so that the test had to be stopped for cleaning the extruder and die plate.

Various modifications of the process of the invention may be made without departing from the spirit or scope thereof and it is to be understood that the invention is intended to be limited only as defined in the appended claims.

What we claim is:

1. In a process for the production of carbon fibers from high boiling bituminous substances in which a purified and polymerized concentrated carbon fiber precursor is spun into fibers which are oxidized and then carbonized and optionally graphitized, the improvement comprising adding to the carbon fiber precursor just before spinning 2 to 10% by weight of a solvent in which the precursor is insoluble or only slightly soluble under normal conditions and mixing the resulting mixture under hypercritical conditions for the solvent for at least 10 minutes to dissolve the solvent in said precursor.

2. The process of claim 1 wherein the solvent is a alcohol which is in liquid form under 100 C. at normal pressure.

3. The process of claim 1 wherein the mixture of solvent and precursor is spun at a temperature of not more than 30° K. above the melting point of the precursor for a period of time of at least 15 minutes.

4. The process of claim 2 wherein the mixture of solvent and precursor is spun at a temperature of not more than 30° K. above the melting point of the precursor for a period of time of at least 15 minutes.

* * * * *